US008910943B2

(12) United States Patent
Lee

(10) Patent No.: US 8,910,943 B2
(45) Date of Patent: Dec. 16, 2014

(54) REACTIVE TARGET WITH POINT OF IMPACT FEEDBACK

(71) Applicant: Joseph E. Lee, Minneapolis, MN (US)

(72) Inventor: Joseph E. Lee, Minneapolis, MN (US)

( * ) Notice: Subject to any disclaimer, the term of this patent is extended or adjusted under 35 U.S.C. 154(b) by 66 days.

(21) Appl. No.: 13/675,456

(22) Filed: Nov. 13, 2012

(65) Prior Publication Data

US 2014/0131950 A1 May 15, 2014

(51) Int. Cl.

*F41J 5/20* (2006.01)
*F41J 1/01* (2006.01)
*F41J 1/10* (2006.01)

(52) U.S. Cl.

CPC ..... *F41J 1/01* (2013.01); *F41J 1/10* (2013.01)
USPC ..... 273/392; 273/407

(58) Field of Classification Search

CPC ..... A63F 9/0204; A63B 63/00; A63B 63/06; A63B 7/00; A63B 7/02; A63B 7/04; A63B 1/10; A63B 5/18
USPC ..... 273/382, 383, 386–392, 403, 406–408, 273/374, 375, 376
See application file for complete search history.

(56) References Cited

U.S. PATENT DOCUMENTS 394,081 A * 12/1888 Patten et al. ..... 273/374
437,267 A * 9/1890 Walker ..... 273/386
799,697 A * 9/1905 Webb et al. ..... 273/374
804,712 A * 11/1905 Ellis et al. ..... 273/374
812,400 A * 2/1906 Bremer ..... 273/375
954,997 A * 4/1910 Rice ..... 273/375
1,348,442 A * 8/1920 Prebble ..... 273/390
1,435,768 A * 11/1922 Wang ..... 273/392
1,547,880 A * 7/1925 Lambert ..... 273/387
1,559,171 A * 10/1925 Knowles ..... 273/392
1,657,931 A * 1/1928 Krantz ..... 273/389
1,680,167 A * 8/1928 Noda ..... 273/379
2,039,552 A * 5/1936 Reynolds ..... 273/391
2,899,204 A * 8/1959 Ratay ..... 273/392
3,411,784 A * 11/1968 James ..... 273/388
3,455,554 A * 7/1969 Rademacher ..... 273/386
3,647,214 A * 3/1972 Hohmann ..... 273/392
4,373,733 A 2/1983 Smith
4,524,976 A 6/1985 Seitz
4,588,194 A * 5/1986 Steidle et al. ..... 273/391
4,614,345 A 9/1986 Doughty
4,917,388 A 4/1990 Marquardt
5,036,613 A 8/1991 Smith
5,240,258 A 8/1993 Bateman
5,257,790 A * 11/1993 Meadows ..... 273/389
5,263,721 A * 11/1993 Lowrance ..... 273/390
5,342,062 A * 8/1994 Lance ..... 273/391
5,501,467 A 3/1996 Kandel
5,533,732 A 7/1996 Leinen, Sr. et al.
6,347,798 B1 2/2002 Quiring et al.
6,896,267 B1 5/2005 Le Anna
7,114,725 B2 10/2006 Camp et al.
7,128,321 B1 10/2006 Brown
7,175,181 B1 2/2007 Bateman et al.
7,201,376 B2 * 4/2007 Kuosa ..... 273/392
7,303,192 B2 12/2007 Marshall et al.

(Continued)

*Primary Examiner* — Mark Graham

(57) ABSTRACT

The target according to the present disclosure is configured to indicate to the shooter whether the shot hit or missed the target. The target also provides the shooter feedback as to shot placement relative to particular locations on the target. This configuration is advantageous for many types of shooting and is especially advantageous in situations where immediate and consistent shot placement feedback is desire.

20 Claims, 8 Drawing Sheets

(56) References Cited

U.S. PATENT DOCUMENTS

| | | | | |
|---|---|---|---|---|
| 7,422,216 | B1 | 9/2008 | Underhill | |
| 7,644,927 | B2 * | 1/2010 | Law | 273/407 |
| 8,172,231 | B2 | 5/2012 | Massier | |
| 2008/0185786 | A1 * | 8/2008 | Loveland et al. | 273/391 |
| 2008/0272548 | A1 * | 11/2008 | Hensley | 273/406 |
| 2008/0277876 | A1 * | 11/2008 | Riley | 273/388 |
| 2013/0001880 | A1 * | 1/2013 | Dean et al. | 273/407 |

* cited by examiner

REACTIVE TARGET WITH POINT OF IMPACT FEEDBACK

TECHNICAL FIELD

The present disclosure provides a reactive shooting target and related methods.

BACKGROUND

Shooting targets are most commonly paper images that include a bullseye in the center of concentric rings. Paper based targets are generally not configured to move or make noise when impacted by the bullet. To determine the point of impact on the target, the shooter typically either walks up to the target to examine the target or the shooter examines the target from a distance with the aid of a spotting scope. The feedback regarding shot placement on such targets is therefore not immediate.

Reactive shooting targets provide the shooter immediate visual and/or audio indication of whether the shot hit or missed the target. An example reactive target is a hanging steel plate. When the bullet impacts the steel plate, the plate will swing and the impact can also be heard. These reactive targets provide advantages over passive targets as the shooter can immediately know if the target was hit. The present disclosure provides an improved reactive type shooting target.

SUMMARY

The target according to the present disclosure is configured to provide immediate indication to the shooter whether the shot hit or missed the target. The target also provides the shooter feedback as to shot placement relative to particular locations on the target (e.g., immediate feedback as to shot placement relative to the bullseye). This configuration is advantageous for many types of shooting and is especially advantageous in situations where immediate and consistent shot placement feedback is desired.

DETAILED DESCRIPTION

The shooting target according to the present disclosure makes shooting more efficient. The shooter need not continuously take down and put up new disposable targets or reset the targets (resetting knock down style targets). When using a shooting target according to the present disclosure, the shooter need not even approach the target until after the shooting session is over. This functionality is of particular value when the target is difficult to access. Examples include where there are multiple shooters at a range and therefore limited opportunities to safely approach the target, when shooting at a target located many hundreds of yards away from the shooter, where the shooter is physically disabled, where the terrain between the shooter and target is difficult to traverse, etc. As will be described in more detail below, it should be appreciated that the target system of the present disclosure could also be used with disposable target components.

The target of the present disclosure also makes shooting more cost effective. As described above, the target components themselves do not need to be constantly replaced like standard paper targets. Also, since the actual impact location of shots that are substantially off the bullseye are reliably tracked, less ammunition is needed to sight in the firearm. In other words, the target according to the present disclosure minimizes the situation where the shooter firing a shot has no idea where the bullet impacted (i.e., the bullet impacts at a unknown location relative to the target) and therefore has no basis to make an adjustment to improve the accuracy of the next shot.

The shooting target according to the present disclosure also enables a shooter to use the same target for precision shooting as well as sighting in the weapon. Initially, the shooter's shots may be impacting a substantial distance from the center of the target yet still impacting on at least one zone of the target. After some adjustments (e.g., adjusting the firearm sights or scope), the shooter can bring the shot groupings closer to the bullseye and continue to shoot at the bullseye target component for precision shooting. This avoids the need to set up multiple targets of different sizes. According to the present disclosure, the bullseye component's effective size can also be adjusted (e.g., the effective size can be adjusted by reorientation of certain target components or swapping certain target components). In addition, as will be described in more detail below, the target of the present disclosure can include multiple "bullseye" of differing sizes as part of the single target.

Figure 1:
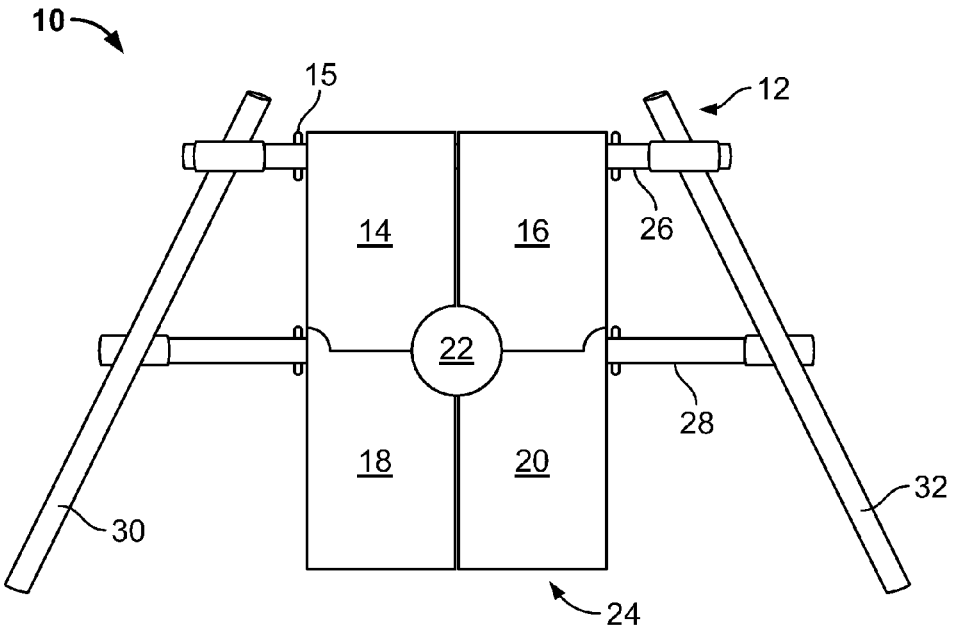
FIG. 1 is a front view of an embodiment of the reactive shooting target according to the present disclosure.
Figure 2:
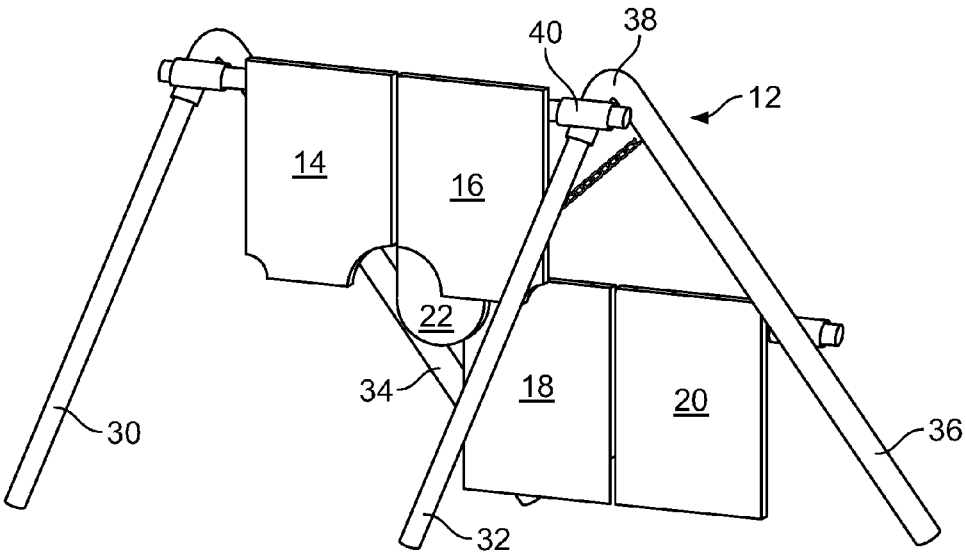
FIG. 2 is a front isometric view of the target of FIG. 1.
Figure 3:
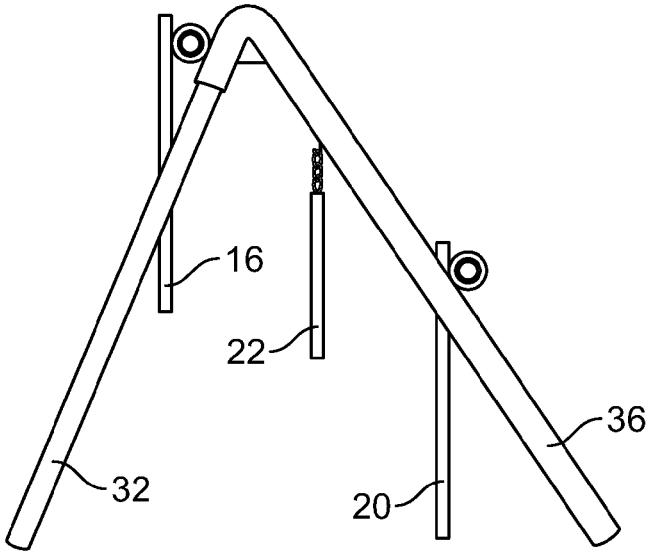
FIG. 3 is a side elevation view of the target of FIG. 1.

Referring to FIGS. 1-3, in the depicted embodiment, the reactive shooting target 10 includes a frame assembly 12. The frame assembly is configured to support front target components 14, 16 such that the upper target components are positioned forward of lower target component 18, 20. In the depicted embodiment, the bottom portions of the lower target components 18, 20 are exposed to the shooter and the top portions of the lower target components are covered by bottom portions of the upper target components 14, 16. In the depicted embodiment the upper left target component 14, the upper right target component 16, the lower left target component 18, the lower right target component 20, and the center bullseye target component 22 together form a single target area 24. It should be appreciated that many other alternative configurations are also possible.

In the depicted embodiment the single target area 24 includes a desired bullet impact zone (e.g., bullseye target component 22), and surrounding target components (e.g, upper left target component 14, the upper right target component 16, the lower left target component 18, the lower right target component 20) that provide feedback to the shooter regarding shot placement on shots that miss the desired impact zone. In the depicted embodiment the upper left and upper right target components 14, 16 are located in a first vertical plane (the forward most vertical plane), the bullseye target component 22 is located in a second vertical plane (a plane rearward of the first vertical plane), and the lower left and lower right target components 18, 20 are located in a third vertical plate (a plane rearward of the second vertical plane). It should be appreciated that many other alternative configurations are also possible.

In the depicted embodiment the upper left and upper right target components 14, 16 are center about the bullseye target component 22 and include quarter circle cutouts to expose an upper portion of the bullseye target component to the shooter. In the depicted configuration the upper right and upper left target components 14, 16 define a semicircular opening with a radius of 2.5 inches. In the depicted embodiment, the upper left and upper right target components includes smaller quarter circle cutouts on the lower outer corners. Therefore, swapping the location of the upper left target component 14 and upper right target component 16 will define a semicircular opening with a radius of 1.5 inches, thereby exposing relatively less of the bullseye component, thereby creating a smaller effective bullseye. The bullseye component can itself be raised in this second configuration to expose less of the bullseye in the vertical direction (e.g., the connection point between chains and the frame or the chains could be adjusted to shorten the effective length of the chains from which the bullseye component hangs). It should be appreciated that many other alternative configurations are also possible.

The lower left and lower right components 18, 20 are also centered about the bullseye target component 22. In the depicted embodiment they do not include cutouts to expose bullseye component 22 since the bullseye component is located forward of the lower components 18, 20 and is already exposed to the shooter. In the depicted embodiment, the bottom edges of the rear plates 18 and 20 are positioned several inches from the ground (e.g., 3 inches) to ensure that the plates do not interfere with the ground as they move rearward and therefore can swing freely when impacted. It should be appreciated that many other alternative configurations are also possible.

The depicted target component arrangement results in precise feedback to the shooter on shots that miss the bullseye. The shooting target in the depicted embodiment provides the shooter information immediately regarding the shot impact location. In other words the target of the present disclosure informs the shooter if the shot missed high, low, to the right, or to the left. The shooting target enables the shooter to make quick adjustments to improve shooting accuracy.

In the depicted embodiment the target area 24 is almost completely closed with minimal through openings. Through openings as referenced herein are openings within a perimeter of the target area 24 that extend through the target from the vantage of a shooter that is located directly in front of the target (e.g., 100 yards up range of the target) that are at least large enough for a bullet to pass through. In the depicted embodiment the target area is rectangular and defined by four lines (an upper line, a bottom line, a left vertical line and a right vertical line). The upper line is defined by the upper edges of upper left and right target components 14, 16. The bottom line is defined by the bottom edge of the lower right and left target components 18, 20. The left vertical edge is defined by the left edge of the upper target component 14 combined with the exposed portion of the left vertical edge of the bottom left component 18 (less than the combination of the vertical edges of upper left target component 14 and lower left component 18). The right vertical edge is defined by the right edge of the upper target component 16 combined with the exposed portion of the right vertical edge of the bottom right component 20. In the depicted embodiment the target area 24 includes a first through opening located between the upper left and upper right target components 14, 16 above the bullseye target component 22. And a second through opening is located below the bullseye target component 22 between the lower left and lower right target components 18, 20. In the depicted embodiment, these two through openings amount to less than twenty percent of the total area of the target area 24 (e.g., less than 15 percent, less than 5 percent, zero percent).

In the depicted embodiment the target components are steel plates (e.g., ¼-½ inch thick AR 500 steel) that are cut into two dimensional simple geometric shapes. In alternative embodiments the shapes can be more complex than those depicted. For example, a hunter type target may include multiple plates that are arranged together to form the shape of an animal silhouette. In some embodiments the target components can be configured to spin when impacted (about a vertical or horizontal axis or both). It should be appreciated that three dimensional objects could also be used as target components (e.g., sphere or cubed shaped target components). In addition, different material can be provided on the target components to provide additional visual feedback (e.g., Tannerite). Also, although in the depicted embodiment the target components overlap or only define small gaps, it should be appreciated that there alternatively could be substantial through spaces between the target components. Also, the target components can be material designed to be destroyed by bullet impacts (wooded plates, thin steel plates, plastic objects, etc.).

In the depicted embodiment, the frame assembly 12 is a freestanding frame that can be assembled and disassembled quickly in the field (e.g., without the need to use tools). The frame assembly 12 includes a front cross bar 26 that extends generally horizontally across a front of the shooting target 10, a rear cross bar 28 that extends generally horizontally across a front of the shooting target. In the depicted embodiment the front cross bar 26 is positioned above the rear cross bar 28. In the depicted embodiment the rear cross bar 28 is rearward of the front cross bar 26. In the depicted embodiment, the upper left and right target components 14, 16 are supported on the front cross bar 26 such that the lower portions of the components move rearward when impacted by a bullet. In the depicted embodiment the target components swing when impacted (pivot about the cross bar). Likewise, the lower left and right components 18, 20 are supported on the rear cross bar 28 such that they also can move rearward when impacted by a bullet. It should be appreciated that many other alternative configurations are also possible.

In the depicted embodiment target components can move independent of each other meaning that moving one of them does not necessarily cause another one to immediately move as well. For example, in the depicted embodiment, if a bullet impacts the lower left target component 18, it would be the only target component that substantially swings. If a bullet impacts the upper left target component 14, it would swing and possibly bullseye component 22 would also swing if the motion of target component 14 was great enough (e.g., bullseye component 22 may swing when component 14 is impacted by a heavy, fast bullet yet not move at all if component 14 is impacted by a lighter, slower bullet).

In the depicted embodiment, the frame assembly 12 includes a first front leg 30 and a second front leg 32, a first rear leg 34 and second rear leg 36. The frame assembly includes a leg connection assembly configured to connect the front leg to the rear leg. The frame assembly also includes a front cross bar mounting assembly configured to engage the front cross bar 26. In the depicted embodiment the leg connection assembly includes a section of pipe 38 that is welded to the rear legs and slideably connected to the front legs. The front cross bar mounting assembly includes a section of pipe 40 that is welded to the leg connection assembly which is configured to slideably engage the front cross bar. In the depicted embodiment the front legs 30 and 32 are interchangeable. It should be appreciated that many other alternative configurations are also possible.

In the depicted embodiment the front legs 30, 32 are more vertical than the rear legs 34, 36. Both the front legs 30, 32 and rear legs 34, 36 angle inwardly when viewed from the front (the legs lean inwardly towards the center of the shooting target). The depicted configuration provides stability to the target. The inward tilt angle of the front and rear legs is defined by the configuration of the cross bar mounts (e.g., the orientation of the pipe sections 40). The angle of the front legs relative to the rear legs is defined by the configuration of the leg connecting assembly (e.g., the orientation of the pipe section 38). It should be appreciated that many other alternative configurations are also possible.

In the depicted embodiment, the upper left and right target components 14, 16 shroud a portion of the front cross bar 26, and lower left and right target components 18, 20 shroud a portion of the rear cross bar 28. This configuration protects the bars from direct bullet impact. In the depicted embodiment rear cross bar 28 is also shrouded by the lower portion of the upper left and upper right target components 14, 16 as the upper left and upper right target components horizontally overlap with the lower left and lower right target components. In other words, an imaginary straight line extending from the shooter's vantage through the lower edge of the upper left target component would pass through the top edge portion of the lower left target component. It should be appreciated that many other alternative configurations are also possible.

Figure 4A:
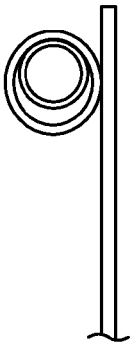
FIGS. 4A-4E are side views of target component mounting assemblies of the present disclosure.
Figure 4B:
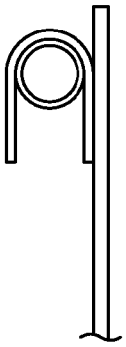
Figure 4C:
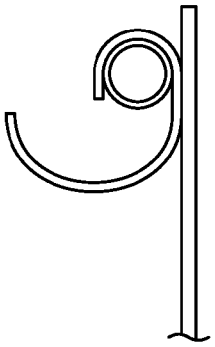

Referring to FIGS. 4A-C, in the depicted embodiment the target components 14, 16, 18, 20 are configured to connect in front of the cross bars 26, 28. The mounting assembly can include one or more sections of pipe welded to the back surface such that they can slide over the cross bars as the frame is being assembled (see FIG. 4A). This configuration allows the plate to rotate 360 degrees around the cross bars 26, 28 without the possibility of inadvertent disengagement therefrom. The mounting assembly can also define a small gap between adjacent plates to prevent the adjacent edges from binding and inhibiting independent movement of the adjacent target components. For example, the sections of pipe could extend 1/32 of an inch thereby maintaining a 1/16 inch gap between adjacent plates. The target components can be held in place by pins 15 at each end that prevent target components from spreading apart during use.

Figure 4D:
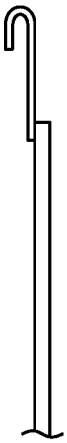
Figure 4E:
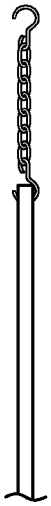

In an alternative embodiment the target components 14, 16, 18, 20 can be configured to be connected to the cross bars 26, 28 after the frame assembly is fully assembled (after the cross bars are engage with the legs). FIGS. 4B and 4C illustrate alternative mounting assemblies that allow the target component to be attached to the cross bars without access to the end of the cross bar. Alternatively, the target components can be hung from the cross bars via cables (FIG. 10), chains (FIG. 4E), sections of bars (FIG. 4D), or the like. In embodiments wherein the target components are hung below the cross bar, the cross bar will be exposed and could be constructed of a bullet proof material (e.g., AR 500 steel) or otherwise protected (e.g., pieces of bullet proof material (AR 500 plate) could be welded to the front surface of the cross bar). It should be appreciated that many other alternative configurations are also possible.

Figure 5:
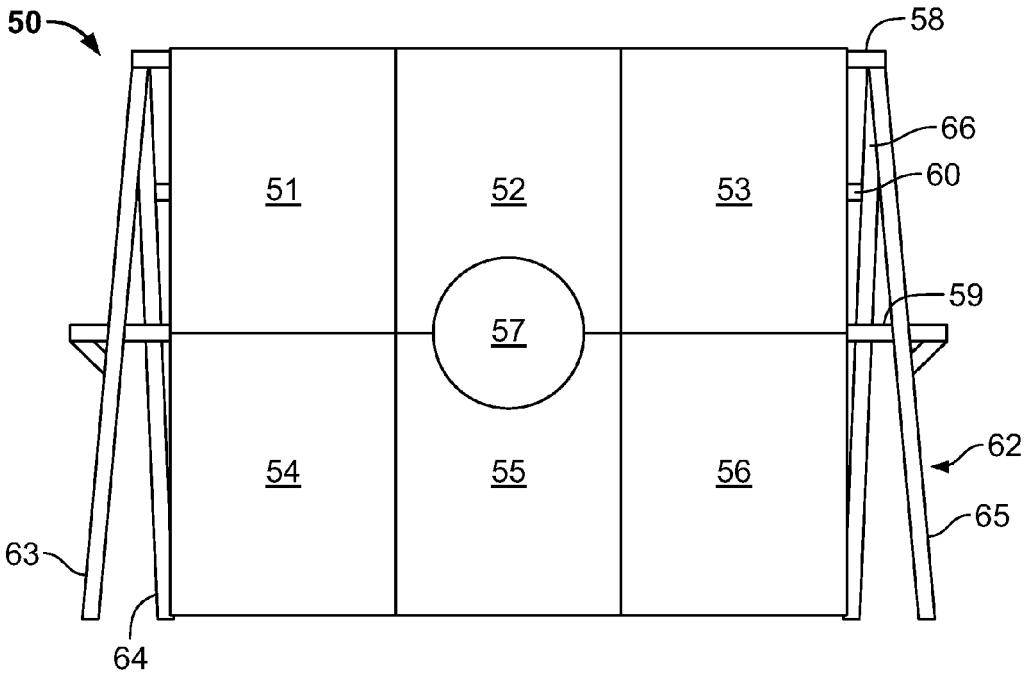
FIG. 5 is a front view of an alternative embodiment of the reactive shooting target according to the present disclosure.
Figure 6:
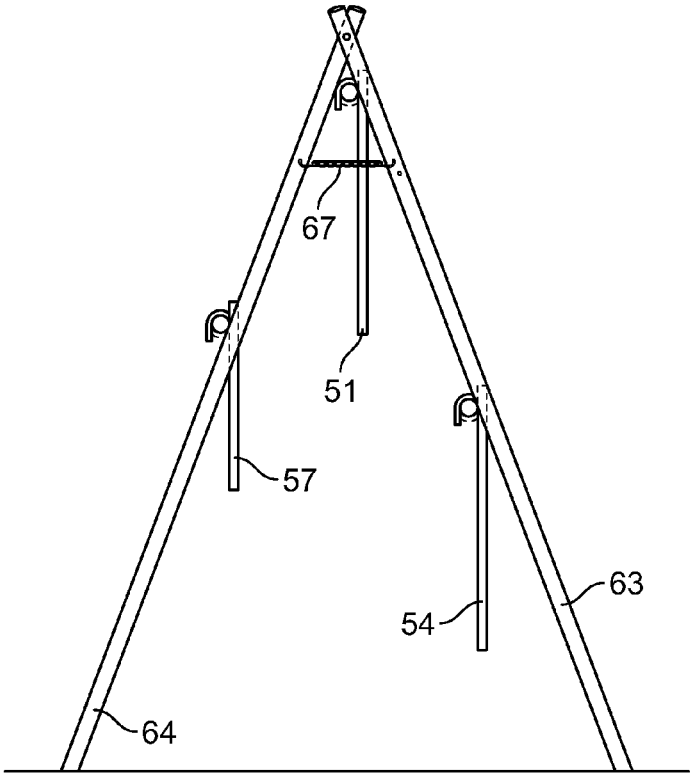
FIG. 6 is a side elevation view of the target of FIG. 5.
Figure 7:
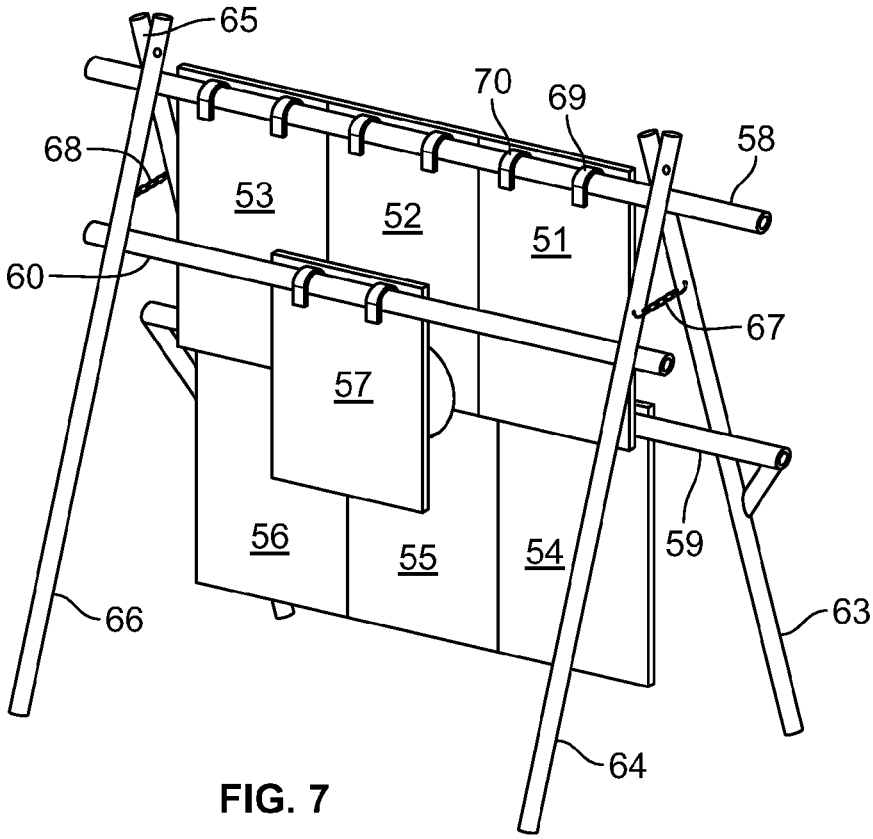
FIG. 7 is a rear isometric view of the target of FIG. 5.

Referring to FIGS. 5-7, an alternative embodiment is shown. In the depicted embodiment the target 50 includes reactive components 51-57 mounted to cross bars 58, 59, 60 that are part of an A-frame target stand 62 which includes two pairs of legs 63, 64, 65, 66. The frame is constructed such that deploying the frame can require simply extending the front legs relative to the rear legs. It further includes the step of mounting cross bars to the legs. This step could entail aligning holes in the cross bars with hook-like bosses extending from the legs. It should be appreciated that many other alternative configurations are also possible (e.g., three-leg frames).

In the depicted embodiment each pair of legs is pinned together at a top end, and the maximum angle between the legs is limited by a linkage or chain 67, 68. Each of the components has a pair of arms 69, 70 that enable the component to hang from the pivot rods 58, 59, 60. In the depicted embodiment the arms are curved to match the profile of the rods, and are open at the bottom end so that the target components can be lifted off and removed. It should be appreciated that many other alternative configurations are also possible.

In the depicted embodiment the target components 54, 55, 56 are in a first plane located closest to the shooter, target components 51, 52, 53 are located in a second plane located rearward of the first plane. Target component 57 is located in a third plane rearward of the second plane. From the front of the target only a circular section of the target component 57 can be seen as the other parts of the target components are shrouded by target components 52, 55. It should be appreciated that many other alternative configurations are also possible.

Figure 8:
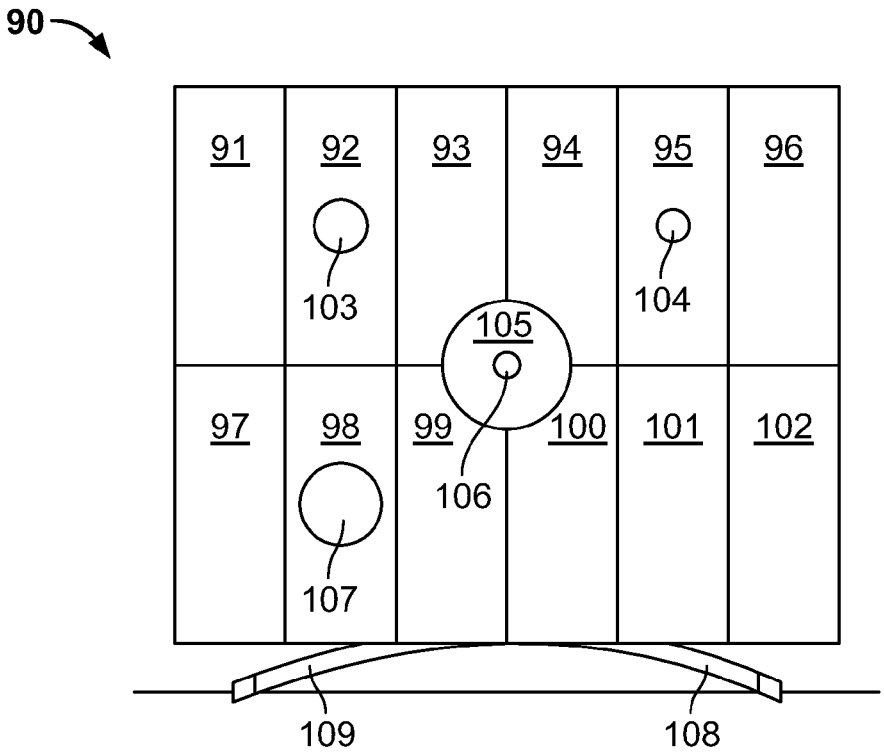
FIG. 8 is a front elevation view of an alternative embodiment of the present disclosure.
Figure 9:
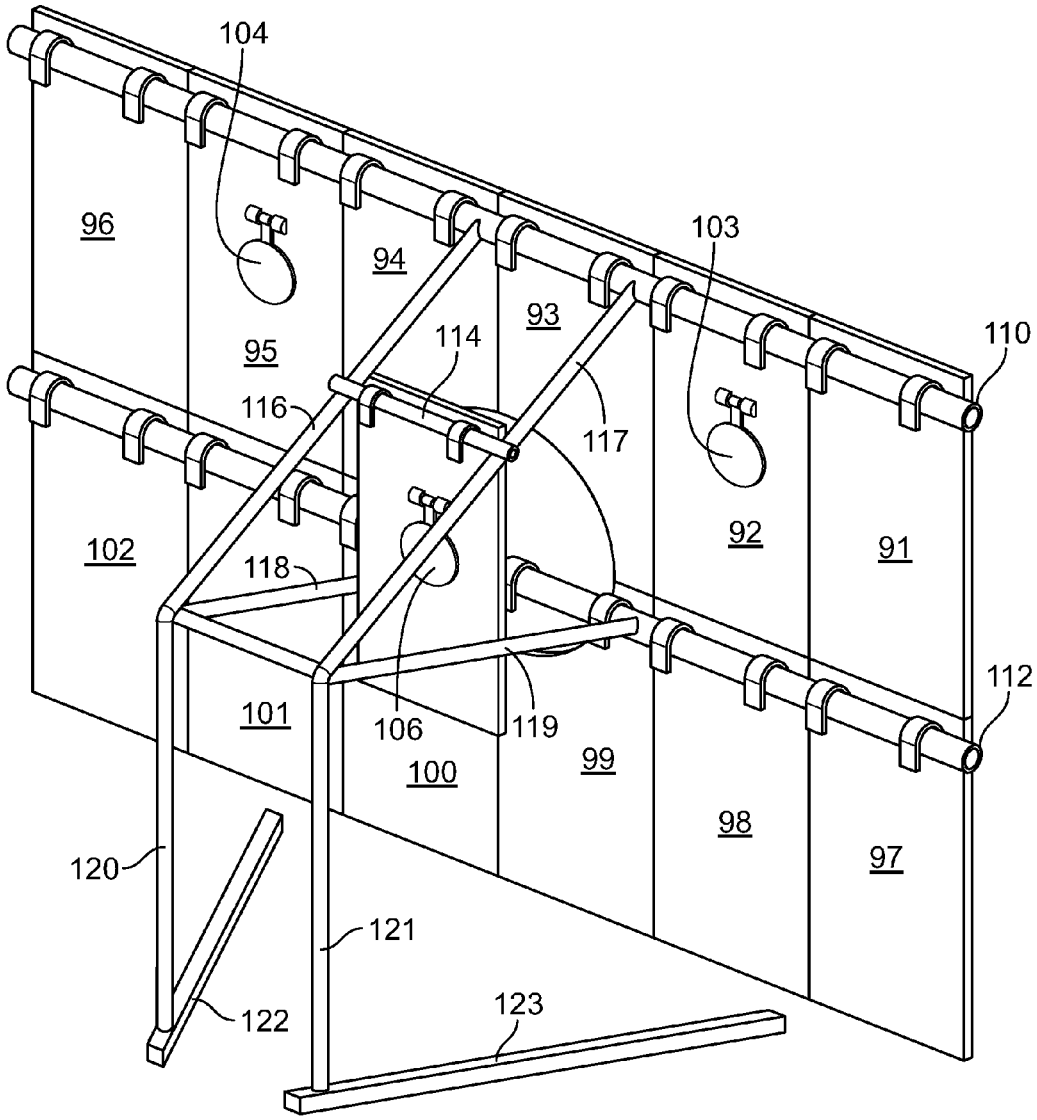
FIG. 9 is a rear isometric view of the target of FIG. 8.

Referring to FIGS. 8-9, another embodiment of the target of the present disclosure is shown. In the depicted embodiment the target 90 includes target components 91-102. Components 92, 95, 105, 98 include sub-components 103, 104, 106, 107. The inclusion of the sub-components allows for precision shooting since the sub components present bullseyes of different sizes. In the depicted embodiment, the main bullseye target component 105 includes a central aperture that is covered by a trap door that defines the sub component 106. It should be appreciated that many other alternative configurations are also possible.

In the depicted embodiment the frame assembly is substantially hidden from a front view which can, in addition to being visually clean, also improve the durability of the target as the bullets will not impact directly on the frame structure located behind the target components. In the depicted embodiment only the lower portions of the legs 108, 109 are exposed. In particular the cross bars 110, 112, 114 and the frame structural members 116-121 are all hidden from the front view and therefor protected by the target components from direct bullet impacts. The legs 122 and 123 extend below and are visible and are constructed to not fail due to multiple bullet impacts. It should be appreciated that many other alternative configurations are also possible.

Figure 10:
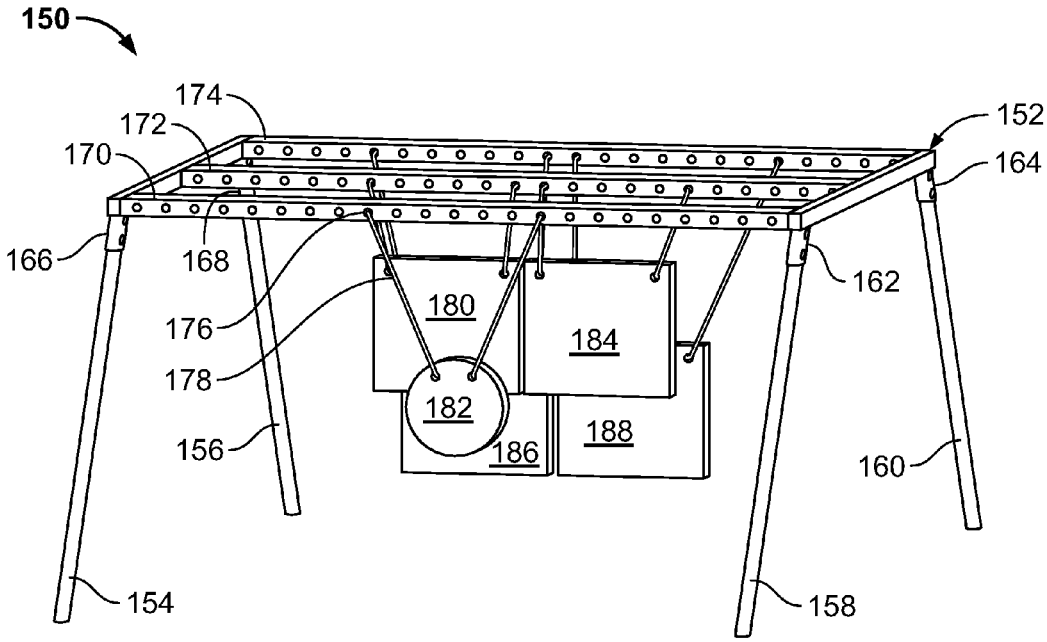
FIG. 10 is a front isomeric view of an alternative embodiment of the reactive shooting target according to the present disclosure.
Figure 11:
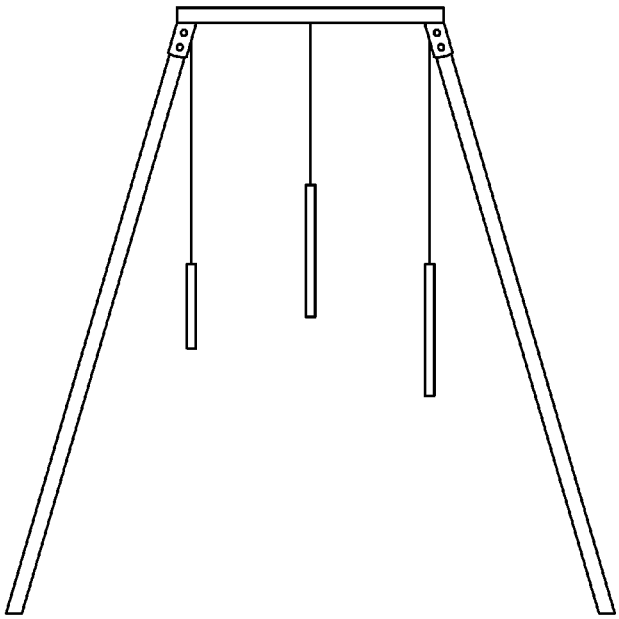
FIG. 11 is a side elevation view of the target of FIG. 10.

Referring to FIGS. 10-11, an alternative embodiment is shown. In the depicted embodiment the shooting target 150 includes a top member 152 and a number of legs that extend therefrom. In the depicted embodiment the legs 154, 156, 158, 160 are removable from the top 152 via a quick connect assembly. Many configurations are possible; for example, the legs 158 and 160 are depicted as being flat steel bars that interlock with tabs 162, 164 that extend downward from the top member 152. The tabs include a pair of bosses that are received in apertures at the upper end of legs 158 and 160 and are retained therein via pins. The legs 154 and 156 have round cross sections and are received within short sections of pipe 166, 168 that extend downward from the top member. It should be appreciated that many other alternative configurations are also possible.

In the depicted embodiment, the top member 152 has an open frame structure with cross bars (170, 172, 174) that extend between the left and right sides of the top member. In the depicted embodiment the cross bars are flat steel members each having a plurality of apertures therethrough to engage hooks 176 that support the cable 178 from which the target components 180, 182, 184, 186, 188 hang. It should be appreciated that the top member can have many alternative configurations. For example the top member could alternatively be a plate with apertures sized so that the cables/chains can be lowered through the apertures from the top and be stopped from falling through the apertures via a washer/nut assembly. Other top configurations are also possible (e.g., a box frame with a steel mesh connected thereto). It should also be appreciated there exist many alternative means for hanging the target components from the top member including, for example, via rods/bars that extend downward or via chains.

In the depicted embodiment, the frame supports the plurality of target components 180, 182, 184, 186, 188 in different vertical planes and together form a single shooting target when viewed from the front. In the depicted embodiment some of the target components overlap when viewed directly from the front such that the shooter does not see substantial gaps between the components.

In the depicted embodiment, target components 180 and 184 are in the same plane and do not overlap with each other. Target components 186 and 188 are in the same plane and overlap in the horizontal direction with target components 180 and 184. Target component 182 is in a third plane and overlaps with each of the other components in the horizontal direction. It should be appreciated that alternatively none of the target components would overlap. For example, there could be a gap in the horizontal direction between the bottom edge of target component 180 and the top edge of target component 186, and target component 180 could have a quarter circle cutout exposing a gap between bullseye target component 182 and target component 180. It should be appreciated that many other alternative configurations are also possible.

This offset vertical plane arrangement allows target elements to swing independently, meaning that one target component can be moved without necessarily immediately moving another target component. For example, the bullseye target component 182 could swing rearward when impacted by a bullet without immediately causing other target components to move. If, however, the bullseye target component is impacted hard and swings back far enough, it may run into target components 180 and 184 causing them to also move some. As described above, target component 180 and 182 can move independently.

Figure 12:
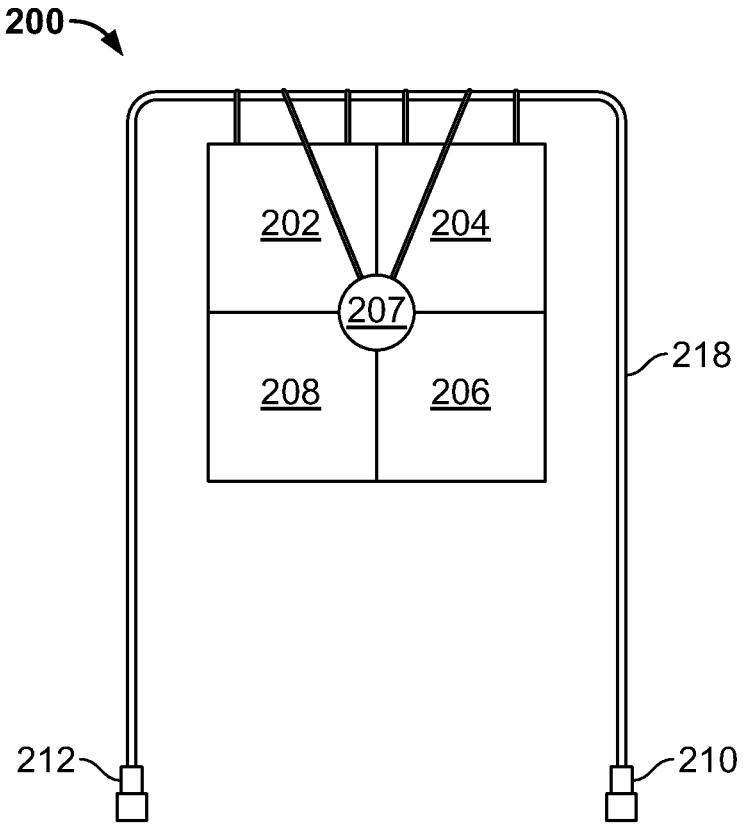
FIG. 12 is a front elevation view of an alternative embodiment of the reactive shooting target of the present disclosure.
Figure 13:
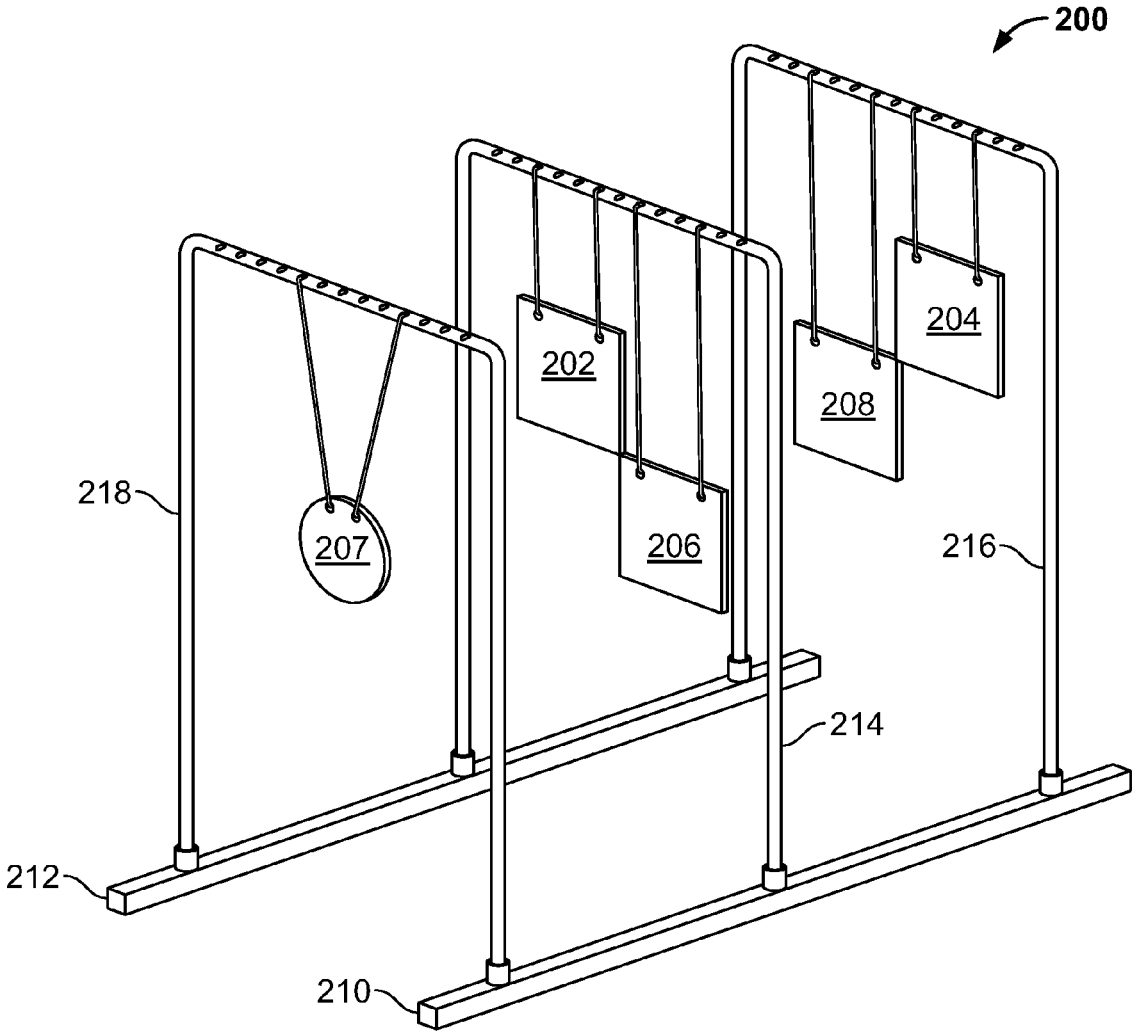
FIG. 13 is a front isometric view of the target of FIG. 12.

Referring to FIGS. 12 and 13, another alternative embodiment is shown. In the depicted embodiment the target components 202, 204, 206, 208 overlap so that the target area does not include through gaps that would allow a bullet to pass through. The target area in the depicted embodiment is defined by the upper edge of component 202 and a portion of the edge of component 204, the lower edge of component 206 and a portion of the lower edge of component 208, the left edge of 202 combined with a portion of the left edge of component 208, and the right edge of component 206 and a portion of the right edge of component 204.

The frame assembly in the depicted embodiment includes a first base leg 212 and a second base leg 210 and a plurality of U-shaped cross bars 214, 216, 218. The cross bars 214, 216, 218 extend between the base legs 212, 210 and provide support for the target components in different vertical planes. In the depicted embodiment the cross bars include a plurality of holes in the upper portion of the cross bars that spans the base legs. Hooks from cables/chains/or bars can extend between the target components and the upper portions of the cross bars. In the depicted embodiment, the lower portion of the cross bars are slideably received in the base for easy assembly and disassembly. The staggered arrangement of the target components (in the vertical direction and the horizontal direction) provides a target area that is substantially free of through gaps. It should be appreciated that many other alternative configurations are possible.

It should be appreciated that many alternative target configurations other than what is depicted in FIGS. 1-13 are possible, different target component sizes and shapes, for example, in different planes. The same frame structure can be configured to be used with multiple different target components (sizes and shapes). This would allow the target system to be used at multiple different distances with multiple different weapons (handguns at close range, .22 rifle with lighter weight small plates, and large caliber rifles at long distances).

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A shooting target comprising:

a frame assembly, a first target component and a second target component connected to the frame assembly such that the first target component overlaps the second target component from a shooter's perspective and both the first and second target components can swing freely like a pendulum from a rest position to a raised position, wherein the first and second target components are arranged such that they will automatically move back to their respective rest positions from their respective raised position due to the force of gravity; and wherein the first and second target components are parts of a target area, the target area defining at least one desired bullet impact location that is shared by at least the first and second target components;

wherein the first and second target components are arranged relative to each other such that at least the second target component swings independent of the first target component when impacted by a bullet such that the swinging motion of the second target component from the rest position to the raised position is viewable by the shooter and thereby provides immediate visual directional feedback to the shooter, the directional feedback including at least one of whether a bullet impact is above, below, to the left of, or to the right of the desired bullet impact location;

wherein the immediate visual directional feedback includes information collected visually by looking only at the target itself and without also looking at a secondary bullet impact location indicator that is separate from the target; and wherein the first and second target components included a non flexible bullet resistant construction.

2. The shooting target of claim 1, wherein through openings within the single target area amount to less than fifteen percent of the total area of the single target area.

3. The shooting target of claim 1, wherein the frame assembly has a freestanding configuration and includes:

a front cross bar extending generally horizontally;

a rear cross bar extending generally horizontally, the rear cross bar positioned rearward of the front cross bar and arranged generally parallel to the front cross bar;

a first target component supported on the front cross bar such that at least a lower portion of the first target component moves rearward when impacted by a bullet; and a second target component supported on the rear cross bar such that the second target component moves rearward when impacted by a bullet, wherein the second target component can move independent of the first target component.

4. The shooting target of claim 3, wherein the free standing frame assembly includes:

a first front leg and a second front leg;

a first rear leg and second rear leg;

a leg connection assembly configured to connect the first front leg to the first rear leg and connect the second front leg to the second rear leg;

a front cross bar mounting assembly configured to support the front cross bar; and a rear cross bar mounting assembly configured to support the rear cross bar, the rear cross bar mounting assembly located on the first and second rear legs.

5. The shooting target of claim 4, wherein the leg connection assembly is integral with the rear legs and slidably connected to the front legs, wherein the front cross bar mounting assembly is integral with the rear legs and slidably connected to the front cross bar, and wherein the front legs are interchangeable.

6. The shooting target of claim 3, wherein the front cross bar is positioned above the rear cross bar.

7. The shooting target of claim 6, wherein the first target component shrouds a portion of the front cross bar, wherein the second target component shrouds a portion of the rear cross bar.

8. The shooting target of claim 1, further comprising a third target component positioned in a vertical plane between the first target component and the second target component and is configured to move when impacted by a bullet, wherein the second target component is configured to move independent of the third target component.

9. The shooting target of claim 3, further comprising a fourth target component supported on the front cross bar such that at least a lower portion of the fourth target component can move rearward when impacted by a bullet, the fourth target component positioned adjacent the first target component and configured such that it can move independent of the first target component.

10. The shooting target of claim 3, wherein a lower edge of the first target component extends lower than the upper edge of the second target component.

11. The shooting target of claim 8, wherein a first target component includes a cut out at a lower portion that exposes a portion of the third target component and the third target component overlaps a top portion of the second target component.

12. The shooting target of claim 3, wherein at least some of the target components are configured to hang off of the front or rear cross bar via a mounting assembly that allows the target component to be connected and disconnected from the cross bar without access to opposed ends of the cross bar.

13. A shooting target comprising:

a frame assembly;

a first target component supported on the frame such that the target component swings like a pendulum about a horizontal axis when impacted by a bullet such at the swinging is viewable by the shooter thereby providing immediate visual shot placement feedback to the shooter by only looking at the target itself;

a second target component supported on the frame such that the target component swings like a pendulum about a horizontal axis when impacted by a bullet such at the swinging is viewable by the shooter thereby providing immediate visual shot placement feedback to the shooter by only looking at the target itself;

wherein the first and second target components are constructed of metal;

wherein the first and second target components are positioned in offset generally vertical planes and form portions of a target area, the target area defining at least one desired bullet impact location that is shared by at least the first and second target components;

wherein the first target component includes a desired bullet impact location and the second target component is positioned adjacent the first target component in a particular direction; and wherein the particular direction including at least one of above, below, to the left of, or to the right of the first target component.

14. The shooting target of claim 13, wherein the first and second target component are self-resetting.

15. The shooting target of claim 13, wherein-the second target component is located either primarily above or below a center of the first target component or primarily to the left or to the right of the center of the first target component wherein the second target component can be moved by a bullet impact without also simultaneously moving the first target component.

16. The shooting target of claim 13, comprising a third target component wherein at least some of the target components overlap at least in the horizontal direction.

17. A method of making a shooting target comprising:

providing a standalone frame assembly that is configured to be assembled and disassembled;

wherein the frame assembly supports a plurality of hanging metal target components;

wherein the plurality of target components are parts of a target area, the target area defining at least one desired bullet impact location that is shared by at least two of the plurality of target components;

wherein through openings within the target area amount to less than twenty percent of the total surface area of the target area, wherein at least two of the plurality of metal target components share a common desired bullet impact location;

wherein the common desired bullet impact location is located on at least one of the plurality of metal target components;

wherein the frame assembly is configured to support the plurality of target components such that at least some of the target components can swing freely about a horizontal axis independent of each other such that the shooter can determine visually what target component has been impacted by the bullet by only looking at the target itself thereby providing visual directional shot placement feedback in real time; and wherein the directional shot placement feedback including at least one of whether an a bullet impacted high, low, left, or right relative to the desired bullet impact location.

18. The method of claim 17, connecting a plurality of target components to the frame such that the target components are arranged in different vertical planes and can move independent of each other and form a single target area including a center target component and target components around the sides of the center target component.

19. The method of claim 17, arranging the target components such that a center target component is in a first vertical plane, and an upper target component is in a second vertical plane, and a lower target component is in a third vertical plane.

20. The method of claim 19, arranging the target components such that an upper right target component is in the second vertical plane adjacent an upper left target component, a lower right target component is in the third vertical plane adjacent a lower left target component, wherein the upper left target component and lower left target component overlap in the horizontal direction.

* * * * *